US007531107B2

(12) United States Patent
Traber et al.

(10) Patent No.: US 7,531,107 B2
(45) Date of Patent: May 12, 2009

(54) AQUEOUS SOLUTIONS OF FLUORESCENT WHITENING AGENTS

(75) Inventors: Rainer Hans Traber, Reinach (CH); Ted Deisenroth, Brookfield, CT (US); Sandra Galle, Weil am Rhein (DE); Helena Dbaly, Muttenz (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 279 days.

(21) Appl. No.: 10/572,152

(22) PCT Filed: Sep. 10, 2004

(86) PCT No.: PCT/EP2004/052119

§ 371 (c)(1),
(2), (4) Date: Mar. 16, 2006

(87) PCT Pub. No.: WO2005/028749

PCT Pub. Date: Mar. 31, 2005

(65) Prior Publication Data

US 2006/0289831 A1 Dec. 28, 2006

(30) Foreign Application Priority Data

Sep. 19, 2003 (EP) ..... 03103454
Feb. 4, 2004 (EP) ..... 04100396

(51) Int. Cl.
*D21H 21/30* (2006.01)

(52) U.S. Cl. ..... 252/301.21; 252/301.22; 252/301.23; 8/611; 8/566

(58) Field of Classification Search ..... 252/301.21, 252/301.22, 301.23
See application file for complete search history.

(56) References Cited

U.S. PATENT DOCUMENTS 3,012,971 A * 12/1961 Sayler et al. ..... 252/301.23
3,239,513 A 3/1966 Hausermann ..... 260/240
4,364,845 A 12/1982 Fringeli ..... 252/301.22
7,258,815 B2 * 8/2007 Drenker et al. ..... 252/301.22

FOREIGN PATENT DOCUMENTS

GB 1 256 660 12/1971
GB 1 304 349 1/1973
WO WO 02/055646 * 7/2002

* cited by examiner

*Primary Examiner*—C. Melissa Koslow
(74) *Attorney, Agent, or Firm*—Joseph C. Suhadolnik

(57) ABSTRACT

Compositions comprising (A) a total of from 2 to 30% by weight, based on the total composition (A)+(B), of one or more amino alcohols of formula (1) herein $R_1$, $R_2$, $R_3$ and $R_4$ are each independently of the others hydrogen, $_1$-$C_{12}$alkyl, $C_5$-$C_{24}$aryl or $C_6$-$C_{36}$aralkyl, and $R_5$ and $R_6$ are each independently of the other hydrogen or $C_1$-$C_4$alkyl; and (B) from 70 to 98% by weight, based on the total composition (A)+(B), of a fluorescent whitening agent of formula (2) herein X is hydrogen, an alkali metal ion, an ammonium ion or a hydroxyalkylammonium radical derived from the amino alcohol of formula (1), and $R_7$, $R_8$, $R_9$ and $R_{10}$ are each independently of the others —$OR_{11}$, —$NR_{11}R_{12}$ or a group of formula (3) wherein $R_{11}$, and $R_{12}$ are each independently of the other hydrogen, alkyl, hydroxyalkyl, alkoxyalkyl, carboxyalkyl, $H_2N$—CO-alkyl or alkylthio, are distinguished by high solubility in water and by high storage stability of the aqueous solutions.

(1)

(2)

(3)

5 Claims, No Drawings

AQUEOUS SOLUTIONS OF FLUORESCENT WHITENING AGENTS

The present invention relates to a composition comprising a sulfo-group-containing fluorescent whitening agent and a β-amino alcohol, to aqueous solutions comprising such a composition and also to the use of the aqueous solutions in the whitening of textile fibres or paper.

Liquid commercial forms of fluorescent whitening agents have the advantage over powders or granules that they are dust-free, can be measured out better and result in a substantial increase in the rate of dissolution in water. However, the solubility of most sulfo-group-containing fluorescent whitening agents in water is insufficient to produce adequately concentrated solutions. In addition, when the aqueous solutions are stored, the fluorescent whitening agents have a tendency to crystallise out. An improvement in solubility and in storage stability is therefore desirable.

It is known that the solubility of fluorescent whitening agents can be increased by adding specific auxiliaries such as urea or ε-caprolactam. However, relatively large amounts of such additives have to be added and then removed subsequently in a laborious waste-water treatment procedure.

It has now been found that the aqueous solubility of sulfo-group-containing fluorescent whitening agents and the storage stability of the aqueous solutions can be substantially improved by the addition of a β-amino alcohol in a relatively small amount.

The present invention relates to a composition comprising (A) a total of from 2 to 30% by weight, based on the total composition (A)+(B), of one or more amino alcohols of formula (1)

(1)

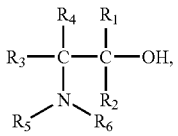

wherein $R_1$, $R_2$, $R_3$ and $R^4$ are each independently of the others hydrogen, $C_1$-$C_{12}$alkyl, $C_5$-$C_{24}$aryl or $C_6$-$C_{36}$aralkyl, and $R_5$ and $R_6$ are each independently of the other hydrogen or $C_1$-$C_4$alkyl; and (B) from 70 to 98% by weight, based on the total composition (A)+(B), of a fluorescent whitening agent of formula (2)

(2)

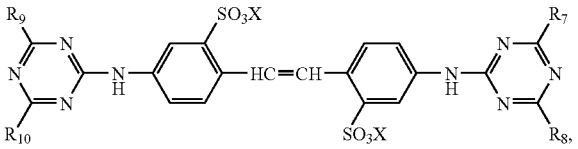

wherein X is hydrogen, an alkali metal ion, an ammonium ion or a hydroxyalkyl-ammonium radical derived from an amino alcohol of formula (1), and $R_7$, $R_8$, $R_9$ and $R_{10}$ are each independently of the others —$OR_{11}$, —$NR_{11}R_{12}$ or a group of formula

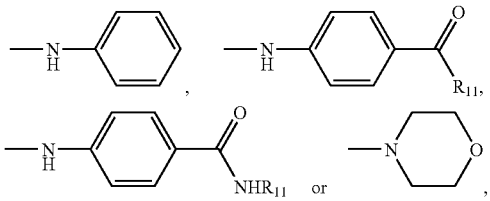

wherein $R_{11}$ and $R_{12}$ are each independently of the other hydrogen, alkyl, hydroxy-alkyl, alkoxyalkyl, carboxyalkyl, dicarboxyalkyl, $H_2N$—CO-alkyl or alkylthio.

When any radicals in formula (1) or (2) are alkyl, such radicals may be straight-chain or branched radicals. Examples thereof are methyl, ethyl, propyl, isopropyl, n-butyl, isobutyl, sec-butyl, tert-butyl, amyl, tert-amyl(1,1-dimethylpropyl), 1,1,3,3-tetramethylbutyl, hexyl, 2-methylpentyl, neopentyl, cyclopentyl, cyclohexyl and their respective isomers.

Aryl radicals as substituents $R_1$ to $R_4$ have preferably from 5 to 24, especially from 6 to 14, carbon atoms and may be substituted, for example by hydroxy, $C_1$-$C_4$alkyl, $C_1$-$C_4$alkoxy, $C_1$-$C_4$hydroxyalkyl, halogen or by the radical —NH—CO—R, wherein R is amino, $C_1$-$C_4$alkyl or unsubstituted or hydroxy-, $C_1$-$C_4$alkyl-, $C_1$-$C_4$alkoxy-, $C_1$-$C_4$hydroxyalkyl- or halo-substituted phenyl.

Examples of suitable aryl groups are phenyl, tolyl, mesityl, isityl, 2-hydroxyphenyl, 4-hydroxyphenyl, 2-chlorophenyl, 4-chlorophenyl, 2,6-dichlorophenyl, 2-aminophenyl, 3-aminophenyl, 4-aminophenyl, 4-methoxyphenyl, 4-ethoxyphenyl, 4-acetylaminophenyl, naphthyl and phenanthryl.

Aralkyl groups as substituents $R_1$ to $R_4$ have preferably from 6 to 36, especially from 7 to 12, carbon atoms and may be unsubstituted or substituted by one or more $C_1$-$C_4$alkyl groups, $C_1$-$C_4$alkoxy groups, halogen atoms or radicals —NH—CO—R, wherein R is amino, $C_1$-$C_4$alkyl or unsubstituted or $C_1$-$C_4$alkyl-, $C_1$-$C_4$alkoxy- or halo-substituted phenyl.

Examples of suitable aralkyl groups are benzyl, 2-phenylethyl, tolylmethyl, mesitylmethyl and 4-chlorophenylmethyl.

X may be, for example, hydrogen, $Na^+$, $K^+$, $NH_4^+$, $N(CH_3)_4^+$, a di- or tri-alkanolammoniu radical, e.g. di- or tri-ethanolammmonium, or a hydroxyalkylammonium radical derived from the amino alcohol of formula (1).

X is preferably hydrogen, $Na^+$ or $K^+$.

Hydroxyalkyl groups suitable as $R_{11}$ or $R_{12}$ are, for example, 4-hydroxy-n-butyl, 3-hydroxy-n-propyl, 2-hydroxy-n-propyl and, especially, 2-hydroxyethyl.

Examples of alkoxyalkyl groups are 2-methoxyethyl and 2-ethoxyethyl.

Carboxyalkyl groups are, for example, 4-carboxy-n-butyl, 3-carboxy-n-propyl, 2-carboxy-n-propyl and, especially, 2-carboxyethyl.

Suitable alkylthio groups are, for example, methylthio, ethylthio and n-propylthio.

Preferred compositions according to the invention comprise, as component (A), 2-amino-2-methyl-1-propanol, 1-amino-2-propanol or a mixture of 2-amino-2-methyl-1-propanol and 2-(N-methylamino)-2-methyl-1-propanol.

As component (B), preference is given to a compound of formula (2) wherein $R_7$ and $R_9$ are each a group of formula

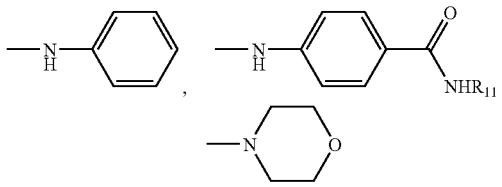

wherein $R_{11}$ is as defined in claim 1.

Preference is furthermore given to compositions according to the invention comprising, as component (B), a compound of formula (2) wherein $R_8$ and $R_{10}$ are each —$NR_{11}R_{12}$ wherein $R_{11}$ and $R_{12}$ are each independently of the other hydrogen, 2-hydroxyethyl, 2-carboxyethyl, —$CH_2CH_2$—$CONH_2$ or —CH(COOH)—$CH_2COOH$.

As component (B), special preference is given to compounds of formulae (2a)-(2f)

(2a)

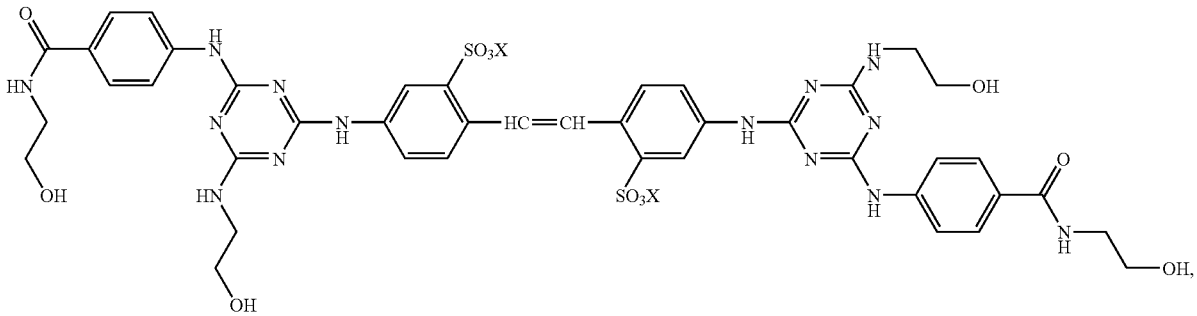

(2b)

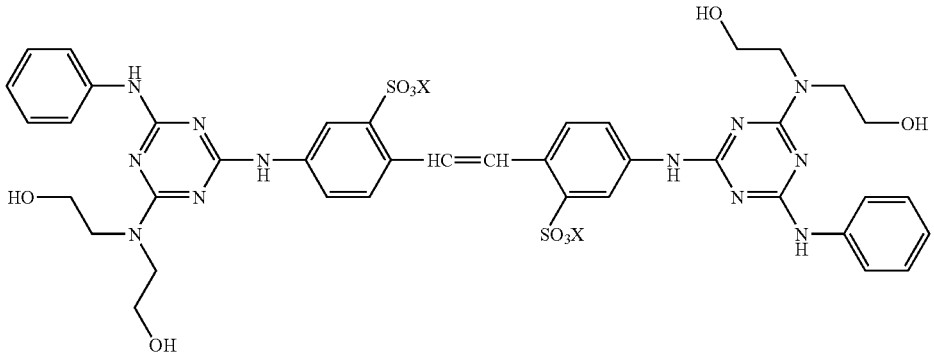

(2c)

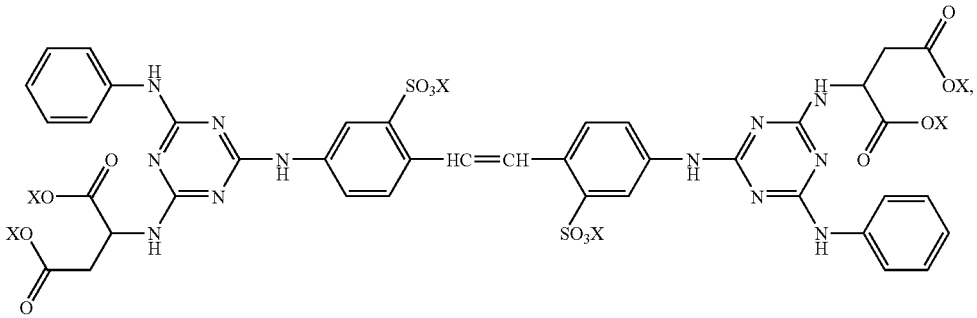

-continued (2d)

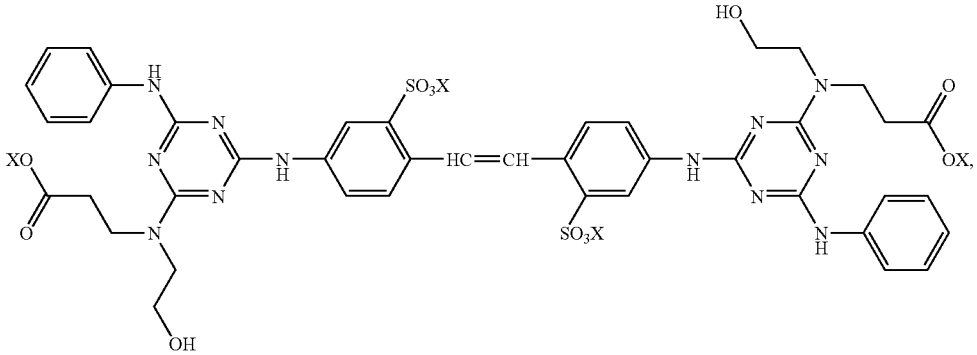

(2e)

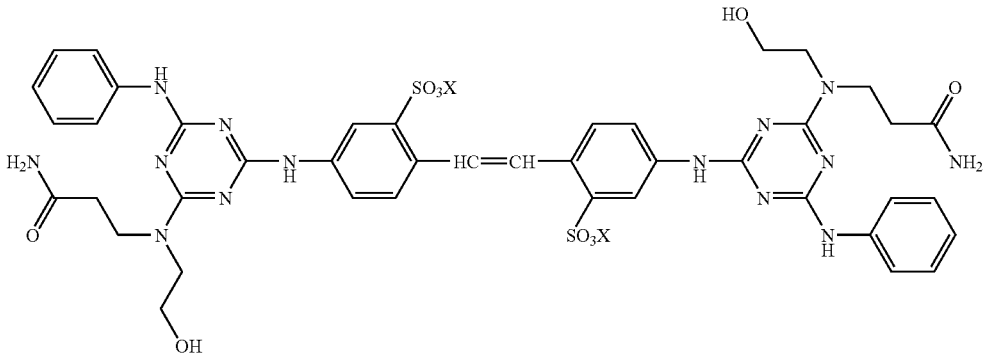

and (2f)

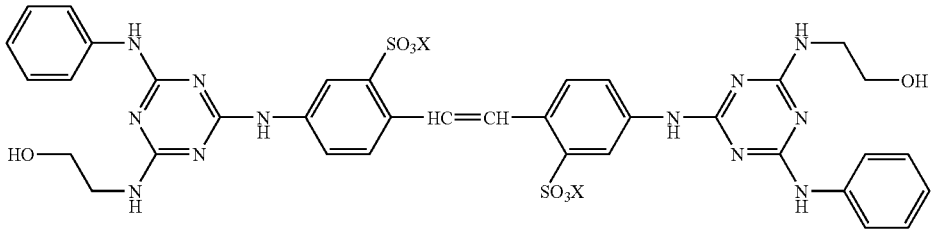

, wherein X is as defined hereinbefore.

Compounds of formula (2) wherein the cation X is derived from an amino alcohol of formula (1) are novel advantageous fluorescent whitening agents in the form of the corresponding hydroxyalkylammonium salts.

The invention accordingly relates also to a compound of formula (3)

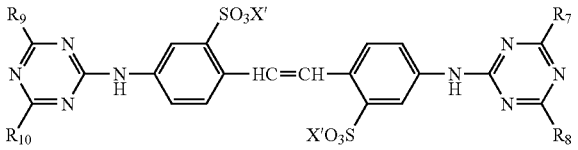

wherein X' is a hydroxyalkylammonium radical derived from an amino alcohol of formula (1) as described hereinbefore and $R_7$, $R_8$, $R_9$ and $R_{10}$ are as defined herein before.

Special preference is given to compounds of formula (3) wherein the hydroxyalkylammonium radical is derived from 2-amino-2-methyl-1-propanol, 1-amino-2-propanol or a mixture of 2-amino-2-methyl-1-propanol and 2-(N-methylamino)-2-methyl-1-propanol.

Such hydroxyalkylammonium salts are prepared by methods known per se, for example by ion exchange of an alkali metal salt or by treating the free acid with the corresponding amino alcohol (1).

As mentioned hereinbefore, an objective of the invention is to produce aqueous solutions having fluorescent whitening agent concentrations that are as high as possible.

The invention accordingly relates also to an aqueous solution containing (A) from 0.5 to 10% by weight of an amino alcohol of formula (1) according to claim 1 or mixtures thereof, (B) from 5 to 40% by weight of a fluorescent whitening agent of formula (2) according to claim 1 or mixtures thereof, (C) from 50 to 90% by weight water, and (D) from 0 to 40% by weight of additives, the sum of components (A)+(B)+(C)+(D) being 100% by weight.

The solutions according to the invention may comprise, as optional component (D), various auxiliaries such as, for example, inorganic or organic acids, inorganic salts, urea, non-ionic surfactants, preservatives or water-miscible organic solvents.

Such additives may, depending on the fluorescent whitening agent used, further improve the properties of the solutions; for example, they may increase the maximum fluorescent whitening agent concentration or further reduce the viscosity.

Preferred solutions according to the invention comprise, as component (D), a preservative.

Water-miscible organic solvents such as alcohols, ether alcohols, glycols or carboxylic acid amides may act as solubility promoters.

Examples of such solvents are propanol, isopropanol, ethylene glycol, propylene glycol, glycerol, di- or tri-ethylene glycol, dipropylene glycol, ethylene glycol monomethyl ether, ethylene glycol monoethyl ether, diethylene glycol monoethyl ether, formamide, dimethyl-formamide, dimethylacetamide, ethanolamine, diethanolamine, triethanolamine, N-methyl-pyrrolidone, polyethylene glycols and polyvinylpyrrolidones.

The solutions according to the invention are generally obtained by dissolving the appropriate fluorescent whitening agent or dye in water or a mixture of water and a water-miscible organic solvent with addition of the amino alcohol of formula (1), where appropriate with heating and stirring.

The solutions according to the invention may, depending on the nature of the dissolved fluorescent whitening agent, be used for the whitening of a very wide variety of high molecular weight organic materials. Suitable substrates for whitening are, for example, synthetic, semi-synthetic or natural textile fibres, paper or washing compositions.

The whitening of paper, and also of textiles, may be carried out in the course of surface finishing. For that purpose, the solutions according to the invention are added to the coating compositions required therefor, the latter being understood to be preparations for the coating of paper and other textile and non-textile, natural or synthetic, organic materials, such as, for example, paper coating compositions. Whitening may be accomplished by incorporating solutions according to the invention in the coating compositions to be applied, which are then applied to the substrates in a manner known per se.

Because the solutions according to the invention can be diluted very readily and rapidly with water, they are also excellently suitable for the whitening of textile substrates using conventional fluorescent whitener agent application methods (e.g. the exhaust method or pad thermo method). For that purpose, the concentrated solutions are so diluted with water that the resulting application solutions, to which conventional auxiliaries may also be added, have the desired fluorescent whitening agent concentrations.

Textile fibres suitable for whitening are those of synthetic materials, e.g. polyamide, of semi-synthetic materials, e.g. regenerated cellulose, and also of natural materials, e.g. wool or cotton, as well as fibre blends, e.g. polyester/cotton, it being possible for the natural fibres also to be provided with a finish in a manner customary in the textile industry.

The textile materials to be whitened may be in a variety of processing states (raw materials, semi-finished products or finished products). Fibre materials may be, for example, in the form of staple fibres, flocks, hanks, textile threads, yarns, twisted yarns, non-woven fibre materials, felts, batts, flocked articles, textile composites or knitted articles but are preferably in the form of woven textiles.

Treatment thereof is carried out using the dilute solutions according to the invention, optionally after adding dispersants, stabilisers, wetting agents and further auxiliaries. Depending on the fluorescent whitening agent dissolved, it may be found to be advantageous to carry out the procedure in an acid, alkaline or, preferably, neutral bath. Treatment is usually carried out at temperatures of about from 20 to 140° C., for example at the boiling point of the bath or thereabout (about 90° C.).

The following auxiliaries may also be added to the bath:

dyes (shading), pigments (coloured or, especially, white pigments), carriers, wetting agents, softening agents, swelling agents, antioxidants, light stabilisers, heat stabilisers, chemical bleaching agents, crosslinking agents, finishing agents and also agents used in various textile finishing methods, especially agents for synthetic resin finishes, and also flame retardant, soft handle, dirt release or antistatic finishes or antimicrobial finishes.

Diluting the concentrated fluorescent whitening agent solutions according to the invention to form the corresponding application baths is carried out in such a manner that, when the substrate in question is impregnated, it takes up the fluorescent whitening agent in an amount of at least 0.0001% by weight, but at most 2% by weight, preferably from 0.0005 to 0.5% by weight. The required concentration is derived by simple means from those values depending on the liquor ratio to be used, the nature of the substrate and the fluorescent whitening agent dissolved.

The solutions according to the invention may also be added to washing baths or to washing compositions. To washing baths there is simply added an amount of solution that contains the desired amount of fluorescent whitening agent. The solutions according to the invention may be added to washing compositions in any phase of the production process, for example to the slurry before atomisation of the washing powder or during preparation of liquid washing agent combinations.

The Examples that follow illustrate the invention:

The solutions described in Examples 1, 2 and 3 are produced by mixing the individual components and are subjected to a storage stability and temperature stability test.

The results are compiled in Table 1.

EXAMPLE 1

22% by weight compound of formula (2b) wherein X is H

5% by weight 1-amino-2-propanol

73% by weight deionised water

EXAMPLE 2

22% by weight compound of formula (2b) wherein X is H

5% by weight 2-amino-2-methyl-1-propanol

73% by weight deionised water

EXAMPLE 3

19.9% by weight compound of formula (2b) wherein X is H 2.5% by weight 2-amino-2-methyl-1-propanol 2.0% by weight KOH (50%)

75.6% by weight deionised water

TABLE 1

| Ex. | Temp. | 1 day | 1 week | 2 weeks | 1 month |
|---|---|---|---|---|---|
| | | Storage stability test at different temperatures | | | |
| 1 | −5° C. | sample frozen | | | |
| | 0° C. | O.K. | O.K. | O.K. | O.K. |
| | RT | O.K. | O.K. | O.K. | O.K. |
| | 40° C. | O.K. | O.K. | O.K. | O.K. |
| | 60° C. | O.K. | O.K. | O.K. | O.K. |
| 2 | −5° C. | sample frozen | | | |
| | 0° C. | O.K. | O.K. | O.K. | O.K. |
| | RT | O.K. | O.K. | O.K. | O.K. |
| | 40° C. | O.K. | O.K. | O.K. | O.K. |
| | 60° C. | O.K. | O.K. | O.K. | O.K. |
| 3 | −5° C. | O.K. | sample frozen | sample frozen | |
| | 0° C. | O.K. | trace of crystal formation on boiling chips | trace of crystal formation on boiling chips | trace of crystal formation on boiling chips |
| | RT | O.K. | O.K. | O.K. | O.K. |
| | 40° C. | O.K. | O.K. | O.K. | O.K. |
| | 60° C. | O.K. | O.K. | O.K. | O.K. |

RT = room temperature

TABLE 2

| Ex. | 0° C. | −2° C. | −4° C. | −6° C. | −8° C. | −10° C. |
|---|---|---|---|---|---|---|
| | Temperature ramp | | | | | |
| 1 | O.K. | O.K. | O.K. | O.K. | O.K. | frozen |
| 2 | O.K. | O.K. | O.K. | frozen | | |
| 3 | O.K. | O.K. | O.K. | O.K. | reversibly frozen | |

TABLE 3

| Example 1 | Example 2 | Example 3 |
|---|---|---|
| 5 freeze/thaw cycles | | |
| O.K. | O.K. | O.K. |

What is claimed is:

1. A composition comprising:

(A) a total of from 2 to 30% by weight, based on the total composition (A)+(B), of 2-amino-2-methyl-1-propanol; and (B) from 70 to 98% by weight, based on the total composition (A)+(B), of a flourescent whitening agent formula (2)

(2)

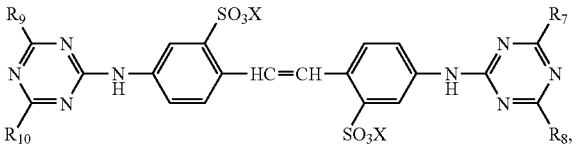

wherein X is hydrogen, an alkali metal ion, an ammonium ion or a hydroxyalkylammonium radical derived from an amino alcohol of formula (1), and $R_7$, $R_8$, $R_9$ and $R_{10}$ are each independently of the others —$OR_{11}$, —$NR_{11}R_{12}$ or a group of formula

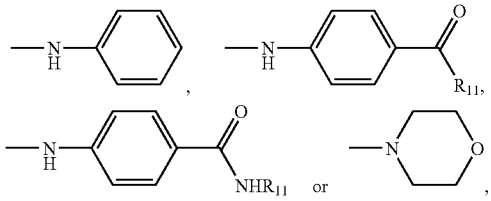

wherein $R_{11}$ and $R_{12}$ are each independently of the other hydrogen, alkyl, hydroxyalkyl, alkoxyalkyl, carboxyalkyl, dicarboxyalkyl, $H_2N$—CO-alkyl or alkylthio.

2. A composition according to claim 1, comprising, as component (B), a compound of formula (2) wherein $R_7$ and $R_9$ are each a group of formula

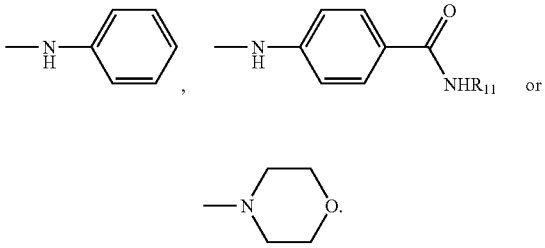

3. A composition according to claim 1, comprising, as component (B), a compound of formula (2) wherein $R_8$ and $R_{10}$ are each —$NR_{11}R_{12}$ wherein $R_{11}$ and $R_{12}$ are each independently of the other hydrogen, 2-hydoxyethyl, 2-carboxyethyl, —$CH_2CH_2$—$CONH_2$ or —CH(COOH)—$CH_2COOH$.

4. A composition according to claim 1, comprising, as component (B), a compound of formula (2a), (2b), (2e) or (2f)

(2a)
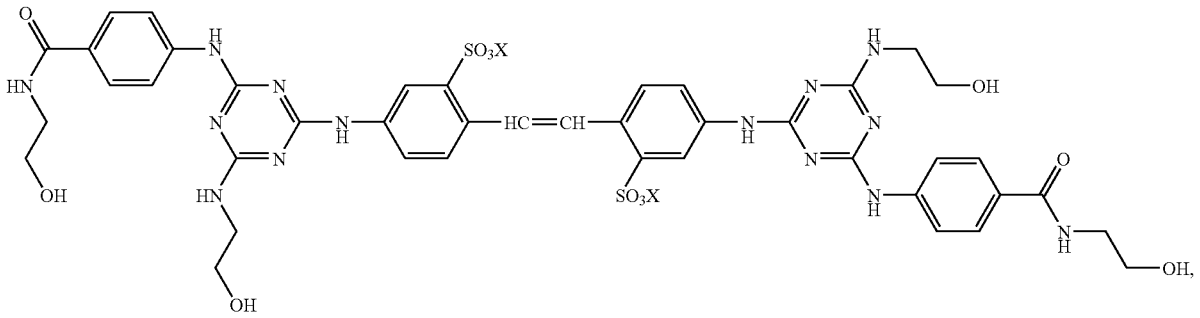
(2b)
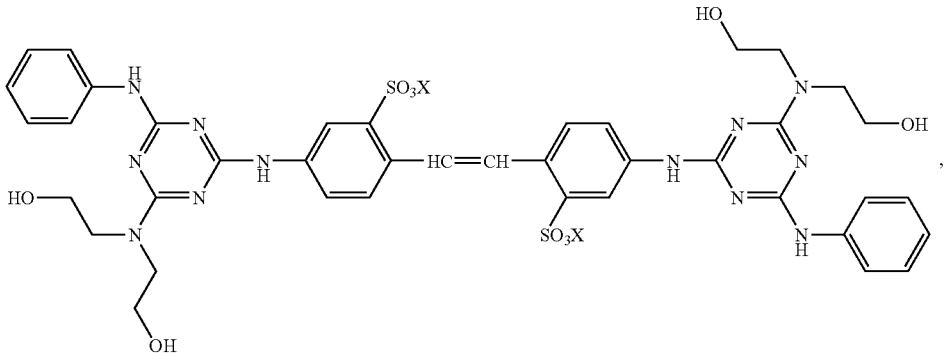
(2e)
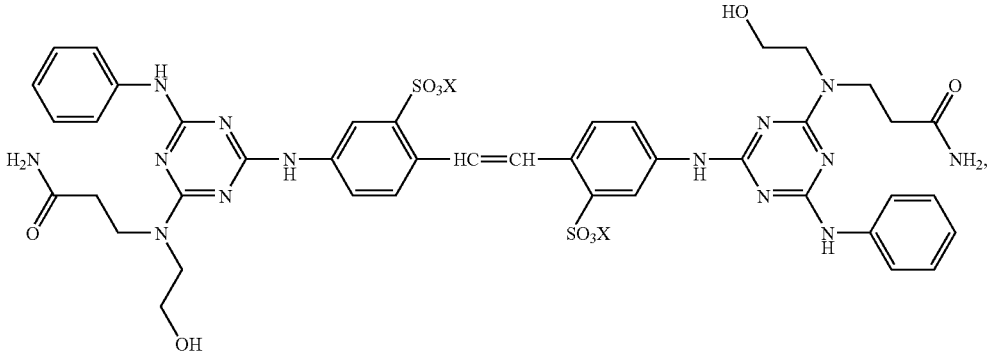
(2f)
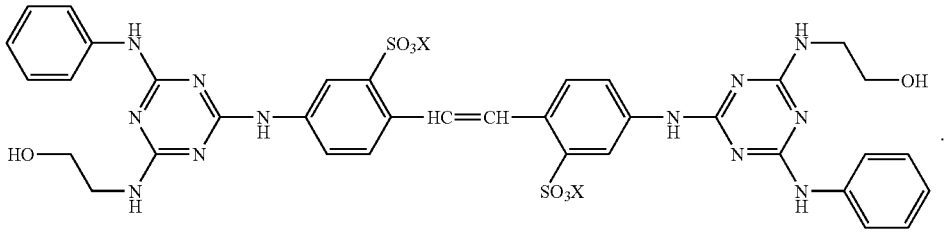
5. A composition comprising:
(A) a total of from 2 to 30% by weight, based on the total composition (A)+(B), of 2-amino-2-methyl-1-propanol; and
(B) from 70 to 98% by weight, based on the total composition (A)+(B), of a flrorescent whitening agent of formula (2c) or 2(d)

(2c)
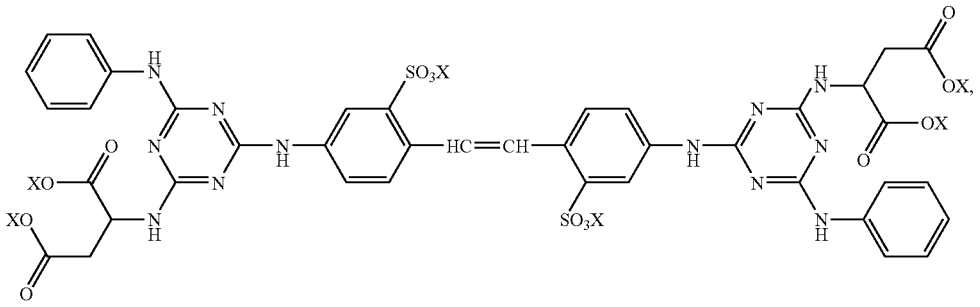
(2d)
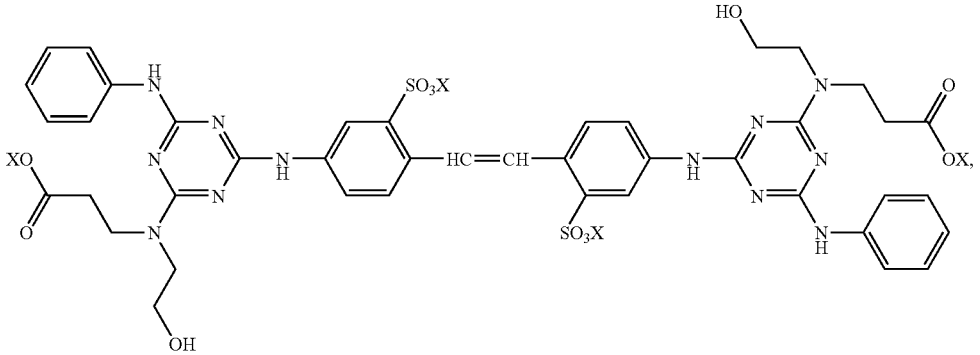
wherein X is hydrogen, an alkali metal ion, an ammonium ion or a hydroxyalkylammonium radical derived from an amino alcohol of formula (1).
* * * * *